US006691652B2

(12) United States Patent
Kammerdiener et al.

(10) Patent No.: US 6,691,652 B2
(45) Date of Patent: Feb. 17, 2004

(54) VARIABLE VALVE DRIVE

(75) Inventors: Thomas Kammerdiener, Graz (AT); Ludwig Buergler, St. Radegund (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/252,440

(22) Filed: Sep. 24, 2002

(65) Prior Publication Data

US 2003/0056745 A1 Mar. 27, 2003

(30) Foreign Application Priority Data

Sep. 25, 2001 (AT) ..... 736/2001 U

(51) Int. Cl.[7] ..... F01L 9/02

(52) U.S. Cl. ..... 123/90.12; 123/90.55; 123/198 F

(58) Field of Search ..... 123/90.12, 90.48, 123/198 F, 90.55–90.59

(56) References Cited

U.S. PATENT DOCUMENTS

| | | | | |
|---|---|---|---|---|
| 4,592,319 A | * | 6/1986 | Meistrick | 123/321 |
| 4,892,067 A | * | 1/1990 | Paul et al. | 123/90.12 |
| 5,005,540 A | | 4/1991 | Watanabe | 123/90.12 |
| 5,127,375 A | | 7/1992 | Bowman et al. | 123/90.12 |
| 5,216,988 A | | 6/1993 | Taxon | 123/90.12 |
| 5,839,400 A | | 11/1998 | Vattaneo et al. | 123/90.16 |
| 6,085,705 A | * | 7/2000 | Vorih | 123/90.12 |
| 6,321,701 B1 | * | 11/2001 | Vorih et al. | 123/90.12 |
| 6,412,457 B1 | * | 7/2002 | Vorih et al. | 123/90.12 |
| 6,510,824 B2 | * | 1/2003 | Vorih et al. | 123/90.12 |

FOREIGN PATENT DOCUMENTS

| | | | |
|---|---|---|---|
| DE | 4317607 | 12/1993 | F01L/1/12 |
| DE | 4325620 | 4/1994 | F01L/1/12 |
| DE | 4324837 | 1/1995 | F01L/1/14 |
| EP | 0156996 | 10/1995 | F01L/31/22 |

* cited by examiner

*Primary Examiner*—Thomas Denion
*Assistant Examiner*—Kyle Riddle
(74) *Attorney, Agent, or Firm*—Dykema Gossett PLLC

(57) ABSTRACT

A variable valve drive for a cam-actuated lift valve of an internal combustion engine which is loaded by a closing pressure against the direction of opening, includes a hydraulic power generating device acting on the lift valve against the closing force with a control piston arranged longitudinally displaceable in a cylinder and adjacent to a hydraulic control chamber, a stroke of the lift valve produced by an actuating cam being at least reducible by removing hydraulic liquid from the control chamber by means of a control valve. In order to arrange the valve stroke and valve opening as free as possible in the simplest possible way the control chamber is connectable with a high pressure level preferably by means of the control valve.

32 Claims, 4 Drawing Sheets

VARIABLE VALVE DRIVE

BACKGROUND OF THE INVENTION

The invention relates to a variable valve drive for a cam-actuated lift valve of an internal combustion engine which is loaded by a closing pressure against the direction of opening, with a hydraulic system comprising a hydraulic power generating device acting against the closing force on the lift valve with a control piston arranged longitudinally displaceable in a cylinder and adjacent to a hydraulic control chamber, with a stroke of the lift valve produced by an actuating cam being at least reducible by gradually removing hydraulic liquid from the control chamber by means of a control valve.

DESCRIPTION OF THE PRIOR ART

A variable valve drive for an internal combustion engine with two intake valves per cylinder is known from U.S. Pat. No. 5,839,400. By relieving the pressure of a chamber disposed between the tappet and the intake valve it is possible to achieve an uncoupling of the stroke movement of the intake valve from the mechanical stroke curve as predetermined by the intake cam. Such a system is known as a "lost motion" system. Such "lost motion" systems are characterized in that the stroke curve which is predetermined by the shape of the actuating cam can only be reduced, but in no way increased. No additional strokes are thus possible.

The U.S. Pat. No. 5,127,375 A for example also describes such a valve drive. The disadvantageous aspect is that in this case too there is no active pressurization within the terms of a hydraulic lifting apparatus and thus no multiple opening of the lift valve per work cycle is possible in a hydraulic manner.

U.S. Pat. No. 5,216,988 A describes a valve actuating device where the pressure generation and the pressure transmission occurs in the bucket tappet. Air bubbles can be removed from the system with a scavenging pump connected in the interior of the bucket tappet and a run-off control valve on the run-off side.

U.S. Pat. No. 5,005,540 A describes a valve control device with a hydraulic bucket tappet disposed between the. cam and lift valve. An admission pressure is produced via an external pump in the hydraulic bucket tappet. The gradual depressurization of the pressure chamber of the bucket tappet occurs via a solenoid valve. An active hydraulic lifting of the valve is also not possible in this case.

A variable valve drive for a lift valve is known from DE 43 17 607 A1 with which a hydraulic additional stroke can be produced during the mechanical lifting phase by a cam. A hydraulic lift is only possible in the known valve drive as long as the pressure line with the pressure conduit, which pressure line is fixed to the housing, overlaps with the power generating device which is formed by a bucket tappet. While the base circle of the cam attacks the bucket tappet, the supply of pressure medium to the bucket tappet is interrupted. The possibility of the hydraulic activation of the lift valve is thus limited to a very short period from a geometrical viewpoint. A reduction of the valve lift within the terms of a "lost motion" system is not provided. The valve lift and the valve control times can thus only be influenced to a very low extent.

SUMMARY OF THE INVENTION

It is the object of the invention to avoid such disadvantages and to arrange the valve lift and valve opening in the freest possible way in a valve drive of the kind mentioned above.

This is achieved in accordance with the invention in such a way that the pressure chamber is connectable with a high-pressure level preferably by means of the control valve. In this way it is possible, in addition to the "lost motion" function, to also achieve an active hydraulic valve actuation. It is thus possible to realize both control times and valve lifts which are situated below the cam-induced mechanical stroke curve of the lifting valve as well as such which are situated above the cam-induced mechanical movement of the lift valve.

In order to realize the desired functions of "lost motion" and "variable valve actuation" it is advantageous when the control valve is a 3/3-way valve which is connected to a control line connected to the control chamber, to a high-pressure line as well as a medium-pressure line. In a particularly compact embodiment it is provided that the control valve is arranged as a control slide valve.

It is provided for in an exceptionally preferred embodiment of the invention that a medium-pressure feed line opens into the control chamber, with the medium-pressure feed line preferably comprising a first non-return valve opening in the direction of the control chamber and preferably the medium-pressure line being arranged as a depressurization line for the control chamber. As a result, a hydraulic valve play compensation can be achieved at a quasi static resting point of the dragging lever. The control valve is situated in a medium position in which the connection between the control chamber and the high-pressure line on the one hand and the medium-pressure line on the other hand is interrupted. The "lost motion" function can be achieved by gradually removing the hydraulic liquid from the control chamber.

In order to ensure an even pressure in the high-pressure line, it is advantageous when the high-pressure line is connected via a first throttle device with a high-pressure reservoir. The high-pressure reservoir can be formed by the distributor line of a fuel injection system. A constant pressure in the medium-pressure line is ensured when the medium-pressure line opens via a second throttle device into a supply tank for the hydraulic liquid.

In a particularly preferable embodiment of the invention it is provided that the high-pressure line and the medium-pressure line are connected with each other via a third throttle device. The throttle devices can be configured as control valves in order to enable a change of the pressure in the high-pressure or medium-pressure line over a wide range. The first, second and third throttle devices form a cascade control which allows operating the variable valve drive with the lowest possible amount of energy input because only such an amount of fuel is taken from the high-pressure reservoir as is momentarily needed by the variable valve drive. In order to adjust the total conveyed quantity, it is provided further that the medium-pressure feed line, is connected downstream of a fore-pump via a fourth throttle device and a high-pressure pump with the pressure line opening into the high-pressure reservoir. The required total conveyed quantity for injection, variable valve drive as well as a control reserve are defined by the fourth throttle device which is arranged as a control valve.

According to a further preferred embodiment of the invention, it is provided that the medium-pressure line is connected via a hydraulic pressure intensifying device with the high-pressure reservoir. As a result of the hydraulic pressure intensifying device, it is possible to use the gradually removed quantity from the pressure chamber during a "lost motion" function of the valve drive in order to fill the pressure reservoir at a low pressure level (medium pressure). Preferably it is provided that the pressure intensifying device is provided with a differential piston adjacent to a working chamber and a pressure chamber, with the medium-pressure line opening into the working chamber and with a pressure line starting out from the pressure chamber which leads to a high-pressure reservoir. At least a partial stroke of a lifting valve is thus used in order to achieve a pumping effect. In order to enable the filling of the high-pressure reservoir by the pumping effect of the lifting valve at a low pressure level, a second non-return valve which opens in the direction of the working chamber is provided on the one hand in the medium-pressure line and a third non-return valve which opens in the direction towards the high-pressure reservoir is provided on the other hand in the pressure line between the pressure chamber and the high-pressure reservoir. In order to feed the pressure chamber of the pressure intensifying device, the same is connected via a feed line with the medium-pressure line, with a fourth non-return valve which opens in the direction towards the pressure chamber being arranged in the feed line.

If, in the case of multi-valve engines for example, only one intake and one exhaust valve are actuated for the gas change in partial-load operation following a port shut-off, the non-actuated valves can be used for filling the high-pressure reservoir. This is especially possible when the camshaft comprising the actuating cams revolves with the crankshaft speed.

It is especially advantageous when a single pressure intensifier and a single high-pressure reservoir are provided for at least for one group of lift valves. Preferably, one medium-pressure line per lift valve is connected with the pressure intensifier and preferably one high-pressure line per lift valve is connected with the high-pressure reservoir. The control of the pressure intensifying device occurs discontinuously by means of a 2/2-way valve which is arranged in a depressurization line which is connected with the working chamber. In order to achieve an individual control of the strokes of the lift valves it is advantageous when a control valve is provided for each lift valve.

A particularly simple and energy-saving variable valve drive can be achieved when the actuating cam acts upon the lift valve via a dragging lever. Preferably, the hydraulic power force generating device is arranged in the zone of the dragging lever bearing, and the bearing point of the dragging lever bearing is adjustable by the power generating device. Moreover, the hydraulic power generating device can also be used in valve drives with rocker levers.

Alternatively, the actuating cam can also act upon the lift valve via a bucket tappet, with the bucket tappet preferably being arranged as a hydraulic power generating device.

The hydraulic system can be connected with a lubricating oil circuit or with a fuel system such as a storage injection system of the internal combustion engine.

BRIEF DESCRIPTION OF THE DRAWINGS

The invention is now explained below in closer detail by reference to the enclosed drawings, wherein.

DETAILED DESCRIPTION OF THE PREFERRED EMBODIMENTS

Figure 1:
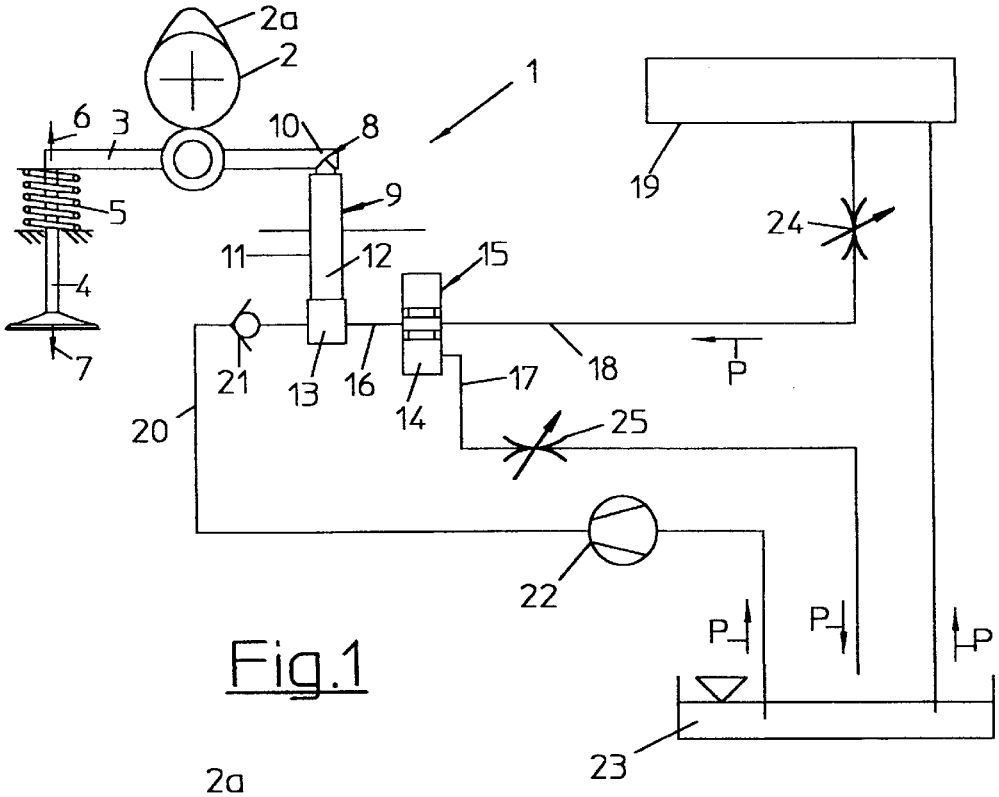
FIG. 1 schematically shows a first embodiment of a variable valve drive in accordance with the invention, FIG. 2 schematically shows a second embodiment of a variable valve drive in accordance with the invention, FIG. 3 schematically shows a third embodiment of a variable valve drive in accordance with the invention, FIG. 4 schematically shows a fourth embodiment of a variable valve drive in accordance with the invention, FIG. 5 schematically shows a fifth embodiment of a variable valve drive in accordance with the invention, and FIG. 6 schematically shows a sixth embodiment of a variable valve drive in accordance with the invention.

Components with the same function are shown in the embodiments with the same reference numerals.

Figure 4:
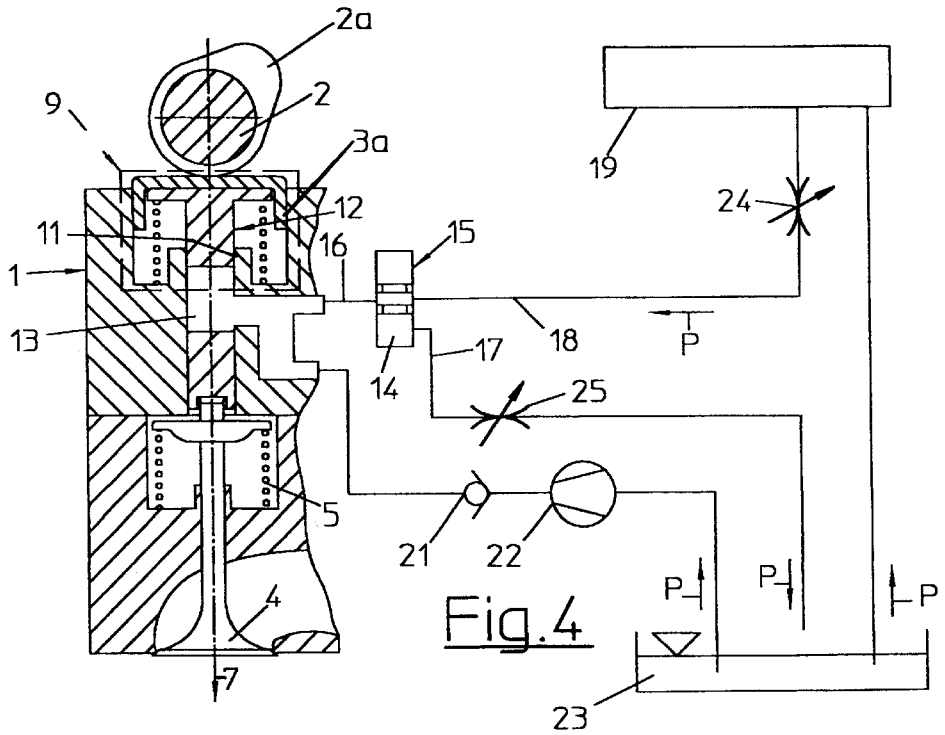
Figure 5:
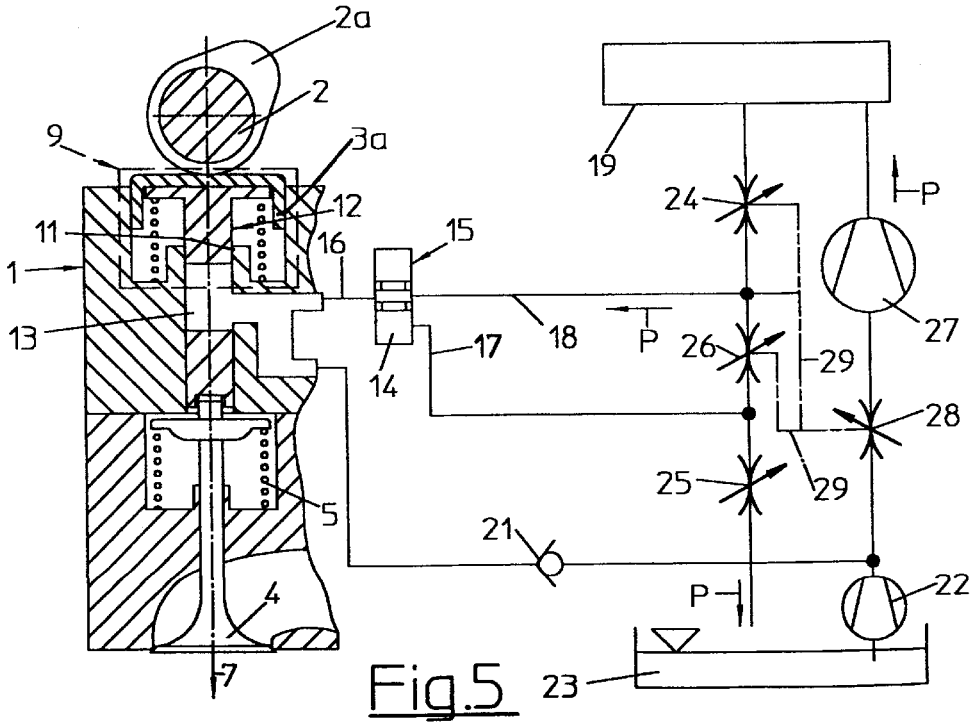
Figure 6:
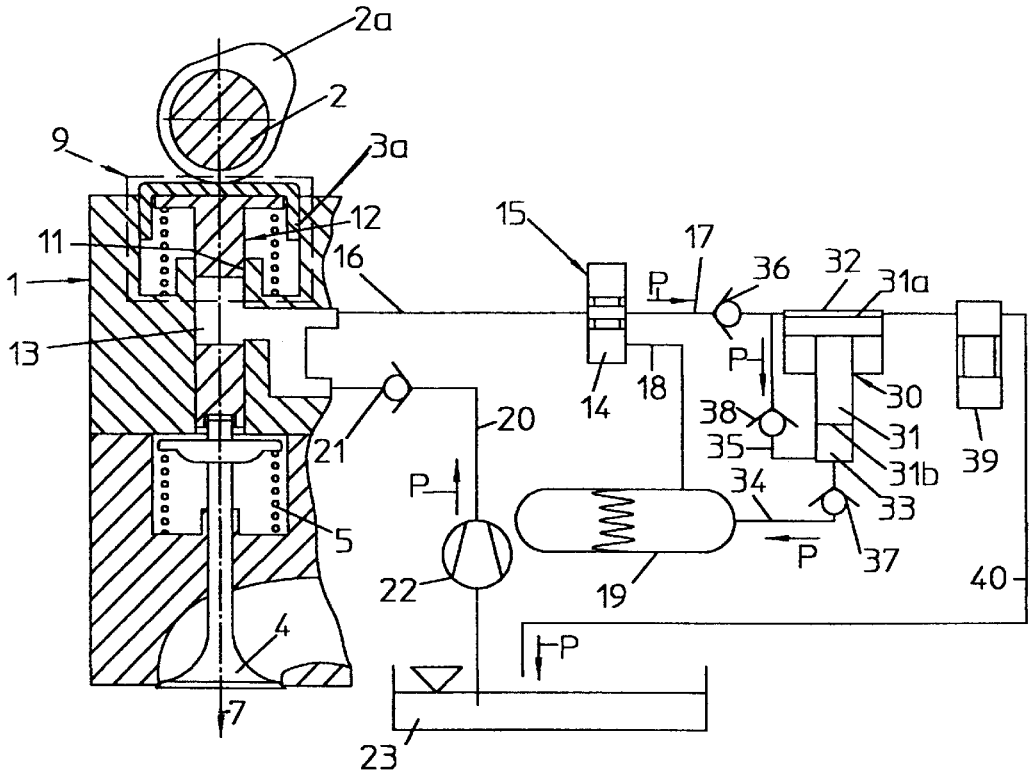

The variable valve drive 1 at least comprises one lift valve 4 which is actuated by an actuating cam 2*a* of a camshaft 2 via a dragging lever 3 (FIGS. 1 to 3) or a bucket tappet 3*a* (FIGS. 4 to 6) and which is loaded against the opening direction 7 by a closing force 6 formed by a closing spring 5. A hydraulic power generating device 9 acts upon the dragging lever 3 in the zone of the dragging lever bearing 8 in FIGS. 1 to 3 and allows a height adjustment of the bearing point 10 of the dragging lever bearing 8. FIGS. 4 to 6 show a bucket tappet 3*a* as a hydraulic power generating device 9, which make it possible to directly influence the lift valve 4.

The power generating device 9 comprises a pressure piston 12 which is arranged in a longitudinally displaceable way in a cylinder 11 and is adjacent to a hydraulic control chamber 13. The control chamber 13 can be connected by means of a control valve 15 formed by a control slide valve 14 via a control line 16 optionally with a medium-pressure line 17 or a high-pressure line 18, with the high-pressure line 18 communicating with a high-pressure reservoir 19. A medium-pressure feed line 20 opens into the control chamber 13, in which feed line there is arranged a first non-return valve 21 which opens in the direction of the control chamber 13. The medium pressure is generated in the embodiments by a medium-pressure pump 22 which withdraws hydraulic liquid formed by fuel for example from a supply tank 23.

In the embodiments as shown in the FIGS. 1, 2, 4 and 5, the high-pressure reservoir is the distributor line (common rail) of a fuel storage injection system and has a pressure of approx. 200 to 2,000 bars. Only a pressure of 80 to 400 bars, preferably approx. 200 bars, are required for actuating the valve drive in the high-pressure line. For reducing the pressure, a first throttle device 24 is arranged in the high-pressure line 18 on the side of the high-pressure reservoir 19. In order to set an even medium-pressure level of approx. 25 bars in the medium-pressure line 17 as well, a second throttle device 25 is also arranged in the medium-pressure line 17 which is arranged as a depressurization line. In order to allow an adjustment of the high pressure and the medium pressure, the throttle devices 24, 25 are arranged as control valves.

Figure 2:
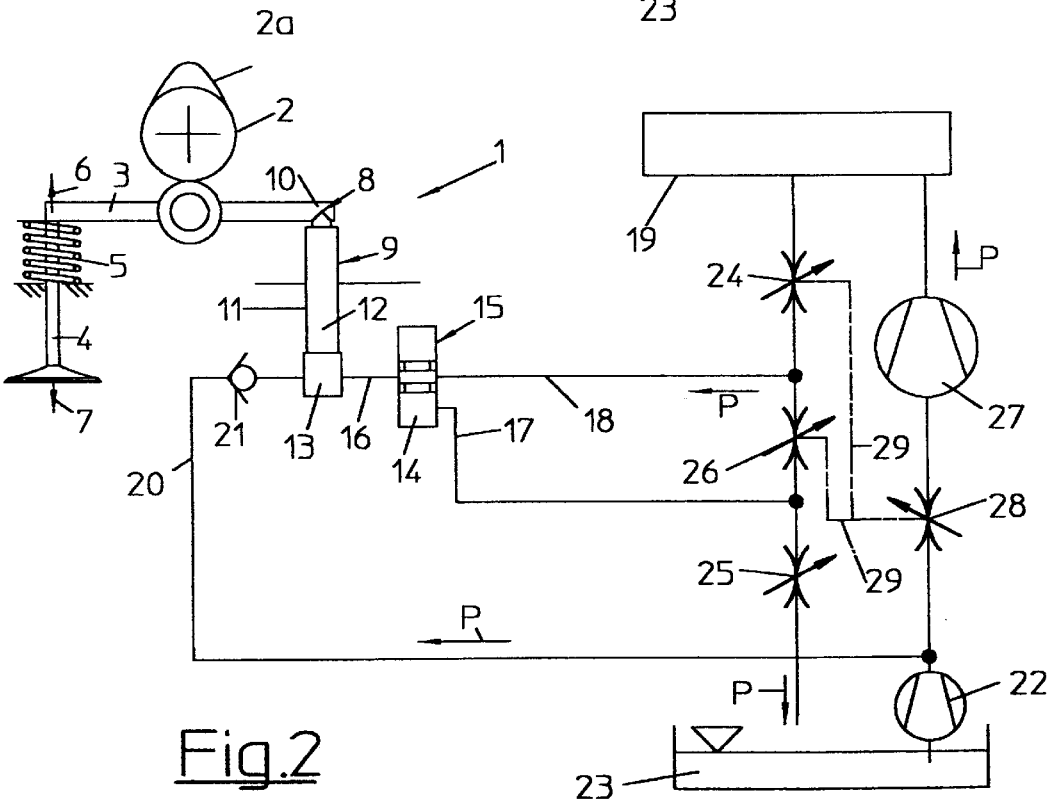

In the embodiments as shown in FIGS. 2 and 5, in the high-pressure line 18 and the medium-pressure line 17 are mutually connected via a third throttle device 26 which is formed by a control valve. Furthermore, a fourth throttle device 28 which is formed by a control valve can be arranged between a fore-pump formed by a medium-pressure pump 22 and a high-pressure pump 27 for feeding the high-pressure reservoir 19. As a result of the cascade control formed by the throttle devices 24, 25 and 26 it is possible to operate the variable valve drive 1 with the lowest possible energy input because only such a quantity of fuel is taken from the high-pressure reservoir 19 as is momentarily needed by the valve drive 1, including a quantity which is required for adjusting the pressure level in the medium-pressure line 17, the high-pressure line 18 and the medium-pressure feed line 20. The required total conveyed quantity for injection and for operating the variable valve drive 1

(plus a reserve for control purposes) is defined by the fourth throttle device 28. In this way the pressure in the high-pressure line 18 can be regulated in a wide range, e.g. between 80 to 400 bars, and the pressure in the medium-pressure line 17 between 1 and 25 bars for example. At least the first, second and fourth throttle device 24, 26, 28 are connected with each other via control lines 29 in order to achieve an adjustment of the system pressure.

The direction of flow of the hydraulic liquid is indicated with the arrows P.

Figure 3:
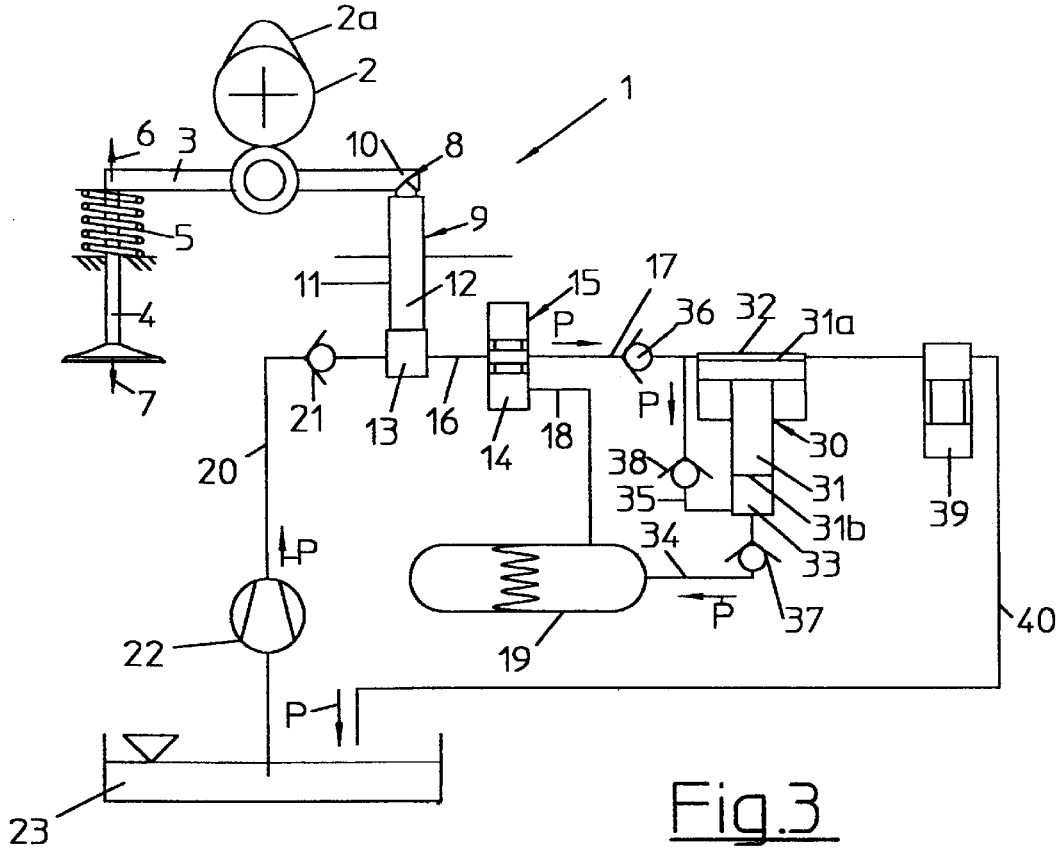

FIGS. 3 and 6 show embodiments in which the pumping effect of at least a partial stroke of a lift valve 4 is used during the "lost motion" function of the valve drive 1 in order to fill the high-pressure reservoir 19. During the filling, the control piston 14 in FIG. 3 is in its lower position in which the connection between the control chamber 13 and the medium-pressure line 17 is produced. Since the pumping effect occurs at a relatively low pressure level of 20 bars for example, a hydraulic pressure intensifying device 30 is used for lifting the pressure to approx. 100 bars in the high-pressure reservoir 19, which intensifying device comprises a differential piston 31. The differential piston 31 borders with its larger face surface 31*a* on a working chamber 32 into which the medium-pressure line 17 opens. The smaller face surface 31*b* of the differential piston is adjacent to a pressure chamber 33 from which a pressure line 34 starts out which leads to a high-pressure reservoir 19. The pressure chamber 33 is connected via a feed line 35 with the medium-pressure line 17 downstream of non-return valve 36 which opens in the direction of the working chamber 32. A third non-return valve 37 is provided in the pressure line 34, which non-return valve opens in the direction towards the high-pressure reservoir 19. A fourth non-return valve 38 is provided in the feed line 35.

When the camshaft 2 revolves with the crankshaft speed, at least every other cam stroke of the actuating cam 2*a* can be used for filling the pressure reservoir 19. It is advantageous especially in multi-valve engines to actuate only one intake and one exhaust valve each per cylinder due to the port shut-off. The remaining lift valves are shut off by means of the power generating element 9 of the valve drive 1, meaning that the control room 13 is connected by means of the control valve 15 with the medium-pressure line 17. The quantity of hydraulic liquid removed from the control chamber 13 can be used to fill the pressure reservoir 19. The medium-pressure lines 17 of deactivate lift valves 4 are supplied to the pressure intensifier 30. In order to achieve the highest possible efficiency, a single pressure intensifier 30 is provided for a group of lift valves 4 or for all lift valves 4. The control of the pressure intensifier 30 is performed via a 2/2-way valve 39 which is arranged in a depressurization line 40 starting out from the working chamber 32. If the control valve 15 is in its middle position in which the medium-pressure line 17 and the high-pressure line 18 are separated from the control chamber 13, the opening of the lift valve 4 occurs according to the mechanical lift curve as predetermined by the actuating cam 2*a* of the camshaft 2, with the function of a hydraulic tappet clearance compensation being given by the medium-pressure feed line 20 and the first non-return valve 21.

The highest possible flexibility in the control of the opening of the lift valves 4 can be achieved by the described variable valve drive 1. Based on a mechanical lift curve as defined by the cam 2*a* of the lift valve 4, it is possible to randomly increase, reduce, shorten or delay the lift of the lift valve 4 within constructively predetermined limits. In particular, a zero lift of lift valve 4 can also be realized.

What is claimed is:

1. A variable valve drive for a cam-actuated lift valve of an internal combustion engine which is loaded by a closing pressure against a direction of opening, with a hydraulic system comprising a hydraulic power generating device acting on the lift valve against the closing force with a control piston arranged longitudinally displaceable in a cylinder and adjacent to a hydraulic control chamber with a medium-pressure feed line opening into the control chamber, with a stroke of the lift valve produced by an actuating cam being at least reducible by removing hydraulic liquid from the control chamber by means of a control valve, wherein the control chamber is connectable with a high pressure level by means of the control valve, wherein the control valve is a 3/3-way valve which is connected to a control line connected to the control chamber, to a high-pressure line showing the high-pressure level as well as to a medium-pressure line, wherein the high-pressure line is connected via a first throttle device with a high-pressure reservoir, and wherein the medium-pressure line opens via a second throttle device into a supply tank for the hydraulic liquid.

2. The valve drive according to claim 1, wherein the control valve is arranged as a control slide valve.

3. The valve drive according to claim 1, wherein a medium-pressure feed line opens into the control chamber, with the medium-pressure feed line comprising a first non-return valve opening in the direction of the control chamber.

4. The valve drive according to claim 1, wherein the medium-pressure line is arranged as a depressurization line for the control chamber.

5. The valve drive according to claim 1, wherein the high-pressure line and the medium-pressure line are connected with each other via a third throttle device.

6. The valve drive according to claim 1, wherein the medium-pressure feed line is connected via a fourth throttle device and a high-pressure pump with the pressure line opening into the high-pressure reservoir.

7. The valve drive according to claim 1, wherein one control valve is provided for each lift valve.

8. The valve drive according to claim 1, wherein the actuating cam acts upon the lift valve via a dragging lever, with the hydraulic power force generating device being arranged in the zone of the dragging lever bearing and the bearing point of the dragging lever bearing being adjustable by the power generating device.

9. The valve drive according to claim 1, wherein the actuating cam acts upon the lift valve via a bucket tappet being arranged as a hydraulic power generating device.

10. The valve according to claim 1, wherein the camshaft comprising the actuating cam revolves with the crankshaft speed.

11. The valve drive according to claim 1, wherein the hydraulic system is connected with a lubricating oil circuit of the internal combustion engine.

12. The valve drive according to claim 1, wherein the hydraulic system is connected with a fuel system of the internal combustion engine.

13. A variable valve drive for a cam-actuated lift valve of an internal combustion engine which is loaded by a closing pressure against a direction of opening, with a hydraulic system comprising a hydraulic power generating device acting on the lift valve against the closing force with a control piston arranged longitudinally displaceable in a cylinder and adjacent to a hydraulic control chamber with a medium-pressure feed line opens into the control chamber, with a stroke of the lift valve produced by an actuating cam being at least reducible by removing hydraulic liquid from the control chamber by means of a control valve, wherein the control chamber is connectable with a high pressure level by means of the control valve, wherein the control valve is a 3/3-way valve which is connected to a control line connected to the control chamber, to a high-pressure line showing the high-pressure level as well as to a medium-pressure line and wherein the medium-pressure line is connected via a hydraulic pressure intensifying device with a high-pressure reservoir.

14. The valve drive according to claim 13, wherein the pressure intensifying device is provided with a differential piston adjacent to a working chamber and a pressure chamber, with the medium-pressure line opening into the working chamber and with a pressure line starting out from the pressure chamber which leads to a high-pressure reservoir.

15. The valve drive according to claim 14, wherein a second non-return valve which opens in the direction of the working chamber is provided in the medium-pressure line.

16. The valve drive according to claim 14, wherein a third non-return valve which opens in the direction towards the high-pressure reservoir is provided in the pressure line.

17. The valve drive according to claim 14, wherein a feed line opens into the pressure chamber, which feed line starts out from the medium-pressure line.

18. The valve drive according to claim 17, wherein a fourth non-return valve which opens in the direction of the pressure chamber is arranged in the feed line.

19. The valve drive according to claim 14, wherein for controlling the pressure intensifying device a depressurization line comprising a 2/2-way valve starts out from the working chamber.

20. The valve drive according to claim 19, wherein the depressurization line opens into the supply tank.

21. The valve drive according to claim 13, wherein a single pressure intensifier and a single high-pressure reservoir are provided for at least for one group of lift valves.

22. The valve drive according to claim 21, wherein one medium-pressure line per lift valve is connected with the pressure intensifier.

23. The valve drive according to claim 21, wherein one high-pressure line per lift valve is connected with the high-pressure reservoir.

24. The valve drive according to claim 13, wherein the control valve is arranged as a control slide valve.

25. The valve drive according to claim 13, wherein the medium-pressure feed line comprises a first non-return valve opening in the direction of the control chamber.

26. The valve drive according to claim 13, wherein the medium-pressure line is arranged as a depressurization line for the control chamber.

27. The valve drive according to claim 13, wherein one control valve is provided for each lift valve.

28. The valve drive according to claim 13, wherein the actuating cam acts upon the lift valve via a dragging lever, with the hydraulic power force generating device being arranged in the zone of the dragging lever bearing and the bearing point of the dragging lever bearing being adjustable by the power generating device.

29. The valve drive according to claim 13, wherein the actuating cam acts upon the lift valve via a bucket tappet, with the bucket tappet being arranged as a hydraulic power generating device.

30. The valve drive according to claim 13, wherein the camshaft comprising the actuating cam revolves with the crankshaft speed.

31. The valve drive according to claim 13, wherein the hydraulic system is connected with a lubricating oil circuit of the internal combustion engine.

32. The valve drive according to claim 13, wherein the hydraulic system is connected with a fuel system of the internal combustion engine.

* * * * *